US006971326B1

(12) United States Patent
Clarke et al.

(10) Patent No.: US 6,971,326 B1
(45) Date of Patent: Dec. 6, 2005

(54) METHOD FOR RUNNING A TUFTING MACHINE

(75) Inventors: Jonathan William Clarke, Christchurch (NZ); Warren John Meade, Christchurch (NZ)

(73) Assignee: Groz-Beckert KG, (DE)

( * ) Notice: Subject to any disclaimer, the term of this patent is extended or adjusted under 35 U.S.C. 154(b) by 0 days.

(21) Appl. No.: 09/936,464

(22) PCT Filed: Mar. 10, 2000

(86) PCT No.: PCT/EP00/02128

§ 371 (c)(1),
(2), (4) Date: Jul. 8, 2002

(87) PCT Pub. No.: WO00/55412

PCT Pub. Date: Sep. 21, 2000

(30) Foreign Application Priority Data

Mar. 12, 1999 (NZ) ..... 334619
Mar. 12, 1999 (NZ) ..... 334620

(51) Int. Cl.[7] ..... D05C 15/08

(52) U.S. Cl. ..... 112/475.23; 112/80.55; 112/275

(58) Field of Search ..... 112/475.23, 80.18, 112/80.23, 80.24, 80.31, 80.41, 80.5, 80.55, 112/275

(56) References Cited

U.S. PATENT DOCUMENTS

| | | | | |
|---|---|---|---|---|
| 4,241,680 | A * | 12/1980 | Hinch et al. | 112/275 |
| 4,392,440 | A * | 7/1983 | Ingram | 112/80.41 |
| 4,860,674 | A * | 8/1989 | Slattery | 112/80.42 |
| 5,193,472 | A * | 3/1993 | Crossley | 112/80.41 |
| 5,526,760 | A | 6/1996 | Ok | |
| 5,588,383 | A | 12/1996 | Davis et al. | |
| 5,738,027 | A | 4/1998 | White | |

FOREIGN PATENT DOCUMENTS

| | | |
|---|---|---|
| GB | 1533707 | 11/1978 |
| JP | 07090766 | 4/1995 |
| JP | 11012915 | 1/1999 |

* cited by examiner

*Primary Examiner*—Peter Nerbun
(74) *Attorney, Agent, or Firm*—John C. Purdue; David C. Purdue

(57) ABSTRACT

The invention concerns a tufting machine having at least one needlebar, loopers, hooks to pick up yarn delivered through the needles of the needlebar, knives to cut yarn loops and driving means, with the needle action and/or the looper action and/or the hook action, and/or the knife action being a non-simple harmonic motion. In said machine the needles, the hooks, the knives and the loopers have separate drive systems. So the motion of the needles, the hooks, the knives and the loopers can be such that first of all the pickup of the yarn or the cutting of the yarn loop can be improved. When the drive system is computer controlled more accurate machine set up can be achieved. Moreover different set ups can be achieved automatically for different products. Patterning effects are also possible.

5 Claims, 4 Drawing Sheets

METHOD FOR RUNNING A TUFTING MACHINE

FIELD OF THE INVENTION

The invention relates to a tufting machine having at least one needlebar, loopers to pick up yarn delivered through the needles of the needlebar(s), and driving means.

BACKGROUND TO THE INVENTION

The action of a needlebar in a tufting machine is controlled by a main drive. Usually the drive is direct coupled and, although antivibration decoupled drive systems have evolved out of recent research to develop high speed tufters, to the best of the applicants' knowledge all needlebars follow a simple harmonic motion, oscillating between top-dead-center (TDC) and bottom-dead-center (BDC) on a regular sinusoidal path.

The pick-up of yarn off of the needle, due to a looper or hook is a critical part of a tufting action which is best achieved slightly after the needle has passed BDC. Halting or slowing the needle at this point would assist the looper with respect to hook yarn pick-up.

In the case of double-sliding needlebar tufters, excess top stroke is required to enable the lateral needlebar shifts to take place and avoid backstitch "tagging" as the needle moves down toward BDC. This can result in loose and uneven backstitches. Similarly, excess bottom stroke is also required to enable clean pick-up of the yarn from both the front and back needlebars. This can cause problems with evenness of the pile surface and so results in a product with lower quality.

Adjustment of the top and bottom needlebar stroke influences the surface and the back-stitch of a tufted carpet. The means of adjustment of current needlebar strokes are generally very crude and often involving (sometimes non-ideal) quantum step adjustments.

Although intermittent feed of the primary backing material is possible with modem tufting machines, it is still possible, that the backing material movement will interferes with the needle stroke. This interference can result when the backing material moves while the needle is still in the backing material. This interference causes stresses on the tufting machine, the tufting needle and carpet primary backing material. The stresses on the machine cause, for example, increased power usage and premature machine wear. The stress on the needle can cause needle breakage. The stresses on the carpet backing material cause distortion of the structure of the primary backing material which in turn can lead to problems with, for example, carpet dimensions. In the case where intermittent backing feed was used, the time available for backing material feeding is limited. In the case where continuous primary backing material feed was used, this stress is even more critical, and can cause severe damages or is the reason for low quality carpet production. In case of producing cut pile carpet the pick up of yarn off the needle after the needle has passed the BDC is done by a hook. Several yarn loops are collected on the hook and are cut by a knife to produce the cut pile carpet. Both motions, the hook motion and the knife motion are of simple harmonic motion and being steadily sine-shaped.

The action of a looper, a hook or a knife in a tufting machine is controlled by a main drive. The coupling between a looper bar, a hook bar and a knife bar supporting a plurality of loopers, hooks or knives in a tufting machine and the main drive may be direct or through other mechanical systems to reduce inertia and vibration but, to the best of the applicants' knowledge, the loopers, the hooks and the knives follow a simple harmonic motion on a regular sinusoidal path.

The most common looper action follows an arc whereby the loopers are "rocked" out (or oscillated) to a pick-up point and back to a position to clear needles of the tufting machine. Patents for a linear motion looper action U.S. Pat. Nos. 5,645,001 and 4,759,199 (assignee Tuftco) have been found. With both arcuate and linear motion the timing of the looper action is critical for good tufting. Furthermore the way in which the looper picks the yarn off the needle, holds it while the needle withdraws and casts off the loop have significant effect on a carpet surface produced in a tufting machine. Same thing is true and valid for the motion of the hook action and the motion of the knife action.

Looper, hook and knife motion timing and set-up are relatively frequently adjusted parameters with different carpet qualities requiring different settings for these parameters.

The means of adjustment of the looper, hook and knife action for timing and pick-up are generally very crude, in some cases involving releasing mounting clamps and knocking the looper, hook and knife assembly into another position with a hammer.

An object of the invention is to overcome the identified disadvantages, provide an alternative choice and improve the action and performance of the needlebars, hooks, knives and loopers of a tufting machine.

Further objects of the invention will become apparent from the following descriptions.

SUMMARY OF THE INVENTION

According to a broadest aspect of the invention there is provided a tufting machine in which the needle action and/or the action of the loopers, hooks and knives is a non-simple harmonic motion, that is a non-sinusoidal motion.

A non-simple harmonic action (n-SHM) needlebar action would also have significant advantages.

Mechanical systems (e.g. cams) can be used to achieve an n-SHM needle action with significant improvements in comparison to conventional needlebar actions. The greatest advantages for an n-SHM needlebar drive system would be achieved through the use of a computer controlled drive system.

The looper, or/and hook or/and knife action, ease of set up and fine tuning can be greatly improved by decoupling the looper, hook and knife drive system from the main drive of the tufting machine. A non-simple-harmonic-motion (n-SHM) drive can be used to give significant advantages for the looper, hook and knife motion.

Mechanical systems (e.g. cams) can be used to achieve n-SHM motion action with significant improvements in comparison to the conventional motion action to move the looper or/and the hook or/and the knives in their advanced and retracted positions. The greatest advantages for a decoupled drive system would be achieved through the use of a computer controlled drive system.

PREFERRED EXAMPLES

As an example, for a comparison between conventional simple harmonic needle and looper action and the non-simple harmonic needle and looper action of the present invention is shown in the accompanying drawing in which.

The shown looper motions are examples and can be substituted by motions for the hooks and the knives.

Figure 4:
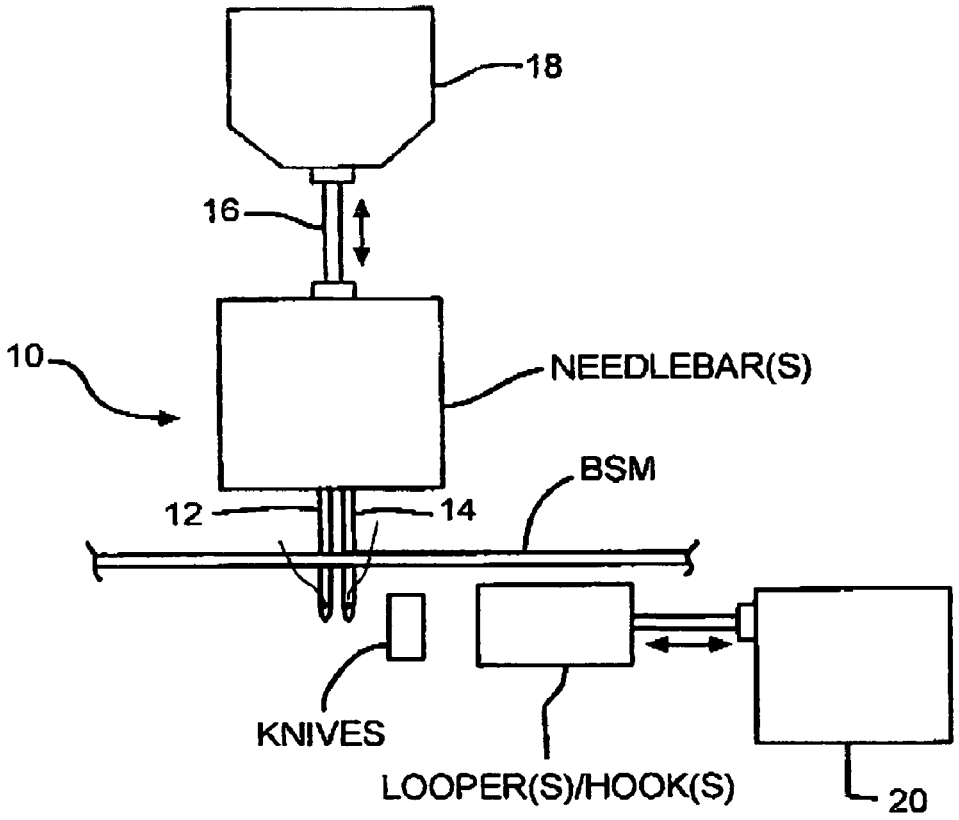
FIG. 4 shows a tufting machine.

Referring now to FIG. 4, a tufting machine is indicated generally at 10. The method of the present invention pertains to the operation of the tufting machine 10 or any other needlebar tufting machine. The tufting machine 10 has needles 12 and 14 which are supported by a needlebar or by needlebars, designated by legend. The needlebar(s) is/are slidably supported on a rod 16 for lateral movement as indicated by an arrow, with respect to backing sheet material BSM. The rod 16 is connected to a needlebar driver 18 which is operable to move the needlebar(s) and the needles 12 and 14, between a top dead center position (not shown) and a bottom dead center position (shown in FIG. 4). A looper or loopers and/or a hook or hooks is/are reciprocated by a driver 20 between a retracted position (shown in FIG. 4) and an extended position (not shown). The tufting machine 10 also comprises a knife or knives, designated by legend. Tufting machines are known but, according to the method of the present invention, the motion of the needlebar(s) and of the looper(s)/hook(s) is varied from the prior art to improve the operation of the tufting machine.

Figure 1:
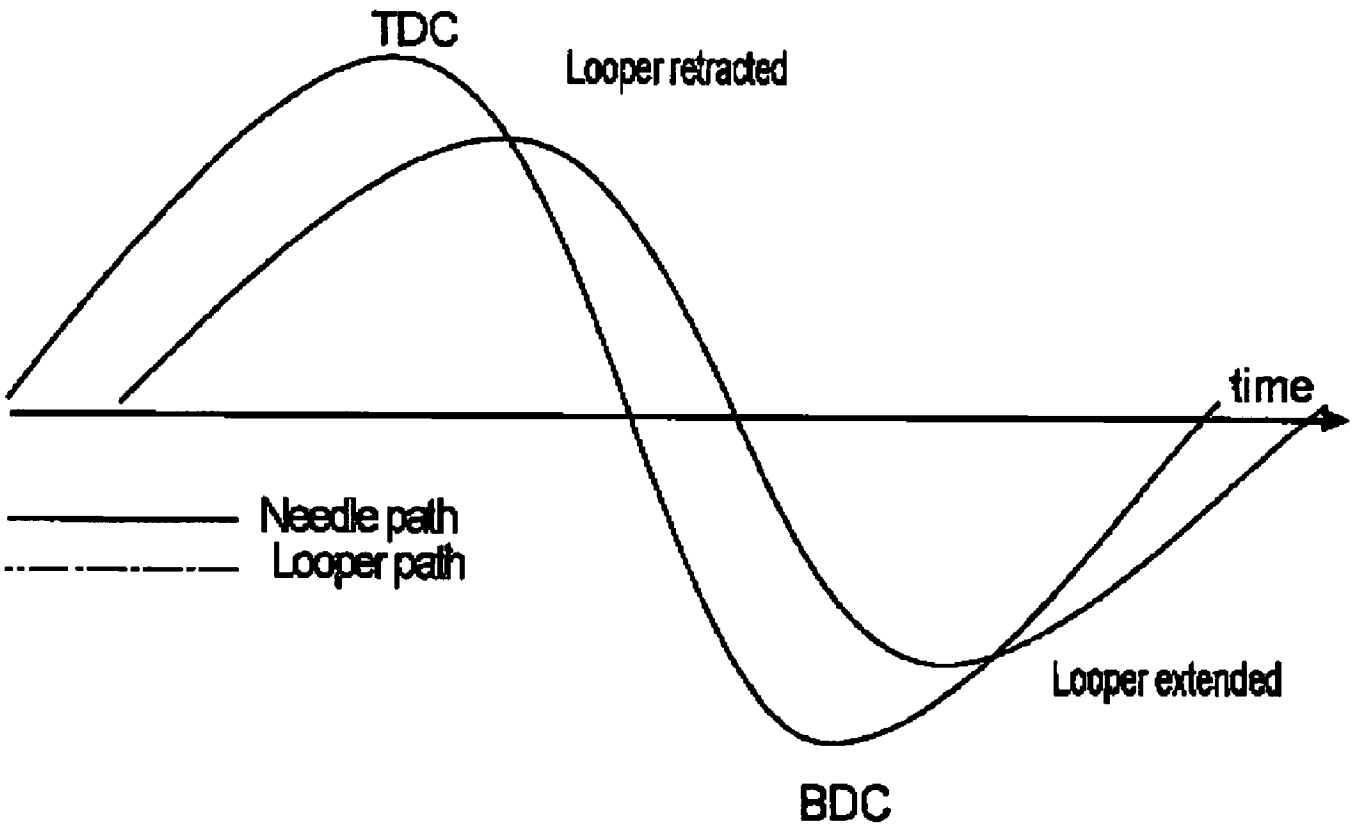
FIG. 1 PRIOR ART
FIG. 1 shows conventional simple harmonic needle and looper action.
Figure 2:
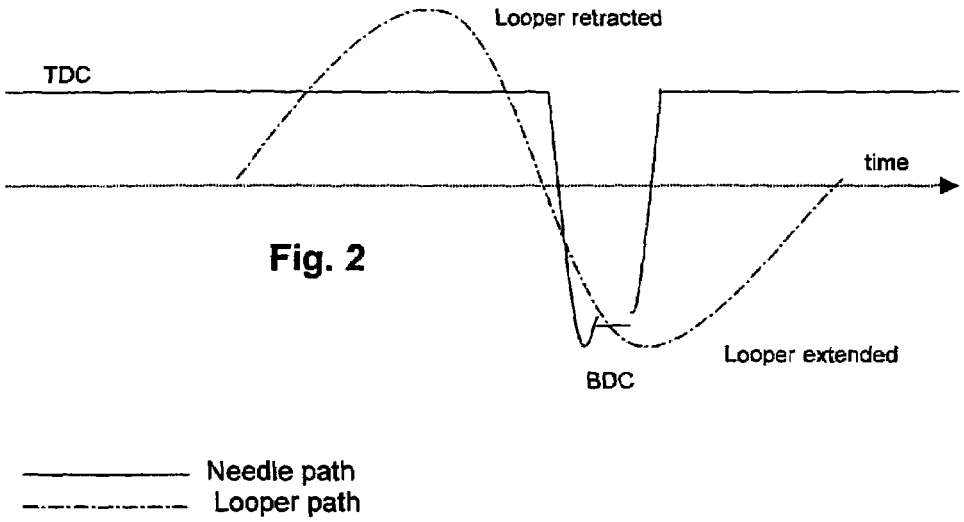
FIG. 2 shows an example of path for the non-simple harmonic motion for a needle with the (SHM) looper path shown as well.
Figure 3:
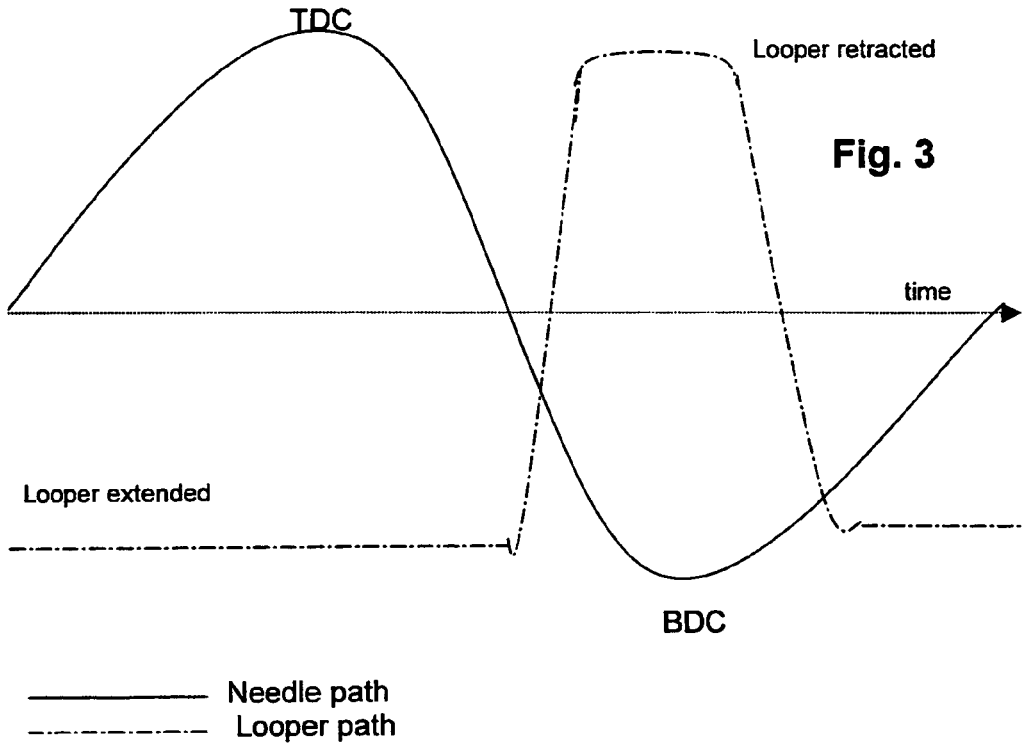
FIG. 3 shows an example of a non-simple harmonic motion for a looper with the (SHM) needle path shown as well.

In FIG. 1 the needle oscillates between top dead center (TDC) and bottom dead center (BDC) with a SHM. The looper oscillates between fully extended and fully retracted with a SHM.

Using an n-SHM needlebar action would enable the needle to be slowed, or halted, at the pick-up point to assist the looper to pick up the yarn from the needle.

An n-SHM needlebar action could also be used to reduce the amount of time that the needle is in the backing (as a percentage of the needle stroke time) which would lead to reduced stress on the tufting machine and reduced distortion of the carpet primary backing.

Although in theory it is possible to vary the distance between rows of tufts (i.e. stitch rate), in practice there is a practical limit on the extent of variation for any given top stroke setting of the needlebar, i.e. limited by the time that the needles are out of the backing. Using an n-SHM needlebar action, the needles could be slowed, or halted, above the backing to extend the time available for increased distance between rows of tufts.

In the case of intermittent primary backing feeding, an n-SHM needlebar action would allow more time for the backing advance to take place, i.e. when the needle was not in the carpet backing.

In the case of double sliding needlebar tufting machines, an n-SHM needlebar action which slowed, or halted, with the needle at TDC could be used to ensure that the needles would not "tag" the backstitches without excess top stroke which would, in turn, result in tighter, more even backstitches. Furthermore, an n-SHM needlebar action which is slowed, or halted, with the needle at the pick-up could be used to ensure good yarn pick-up without excess bottom stroke which would, in turn, result in a more even carpet surface.

A computer controlled needlebar drive system would also enable the action to be electronically fine-tuned to a high level of precision. Different set ups could be achieved automatically for a different product as is currently done for other tufting parameters, such as yarn feed, pile height, primary backing feed, etc, as in U.S. Pat. No. 4,867,080.

Patterning effects may also be possible through variation of the needlebar stroke between rows of the same product.

It is expected that an n-SHM needlebar action would also lead to reduced machine vibration, which in turn, could enable higher speed operation. Further advantages could also be accrued through the use of shorter needlebar strokes and intermittent needlebar action.

A non-simple-harmonic-motion looper action enables more precise control of the timing for the looper extension to pick-up the yarn from the needle at the optimum position on the needle. Furthermore, the looper can remain "extended" to hold the loop until later in a tufting cycle, i.e. until the backing has advanced on to trap the backstitch under the presser foot to reduce the tendency for yarn to be "robbed-back" as the next tuft is inserted.

In more sophisticated versions, the looper can "track" the tuft at the same speed as the backing advance to maintain the loop height, shape, etc.

A computer controlled looper drive system also enables the action to be electronically fine-tuned to a high level of precision. Different set ups can be achieved automatically for a different product as is currently done for other tufting parameters, such as yarn feed, pile height, primary backing feed, etc, as in U.S. Pat. No. 4,867,080.

Patterning effects may also be possible through pile height control and variation by the modified action of the looper.

It is expected that an n-SHM looper action would also lead to reduced machine vibration, which in turn, could enable higher speed operation. Further advantages should also accrue through the use of shorter looper strokes and intermittent (compared with continuous) looper action.

The foregoing description particular refers to the looper motion it is envisaged that the advantages on the looper motions are also valid for the motions of the hooks and the knives. Precise and timely adjusted n-SHM knife motion will assure a good precise cutting of the loops which will result in high quality cut pile carpet.

Where in the foregoing description particular reference has been made to mechanical equipment it is envisaged that their mechanical equivalents can be substituted as if they were individually set forth.

Particular examples of the invention have been described and it is envisaged that improvements and modifications can take place without departing from the scope thereof.

What is claimed is:

1. A method for running a tufting machine having at least one needlebar, loopers and/or hooks to pick up yard delivered through the needles of the needlebar, knives to cut the yarn loops, and driving means, wherein, according to the method, the needle action and/or the book and/or looper action and/or the knife action is/are non-simple harmonic motion(s), wherein the needlebar(s) is/are slowed or halted when the needles are at the yarn pickup point to assist the looper and/or the hooks to pick up yarn from the needles and wherein the loopers and/or the hooks are held in an extended position to hold the loops until later in the tufting cycle.

2. The method for running a tufting machine claimed in claim 1 wherein the needlebar(s) is/are slowed or halted when the needles are above the backing material to extend the time available for advancing the primary backing material.

3. The method for running a tufting machine claimed in claim 1 or 2 wherein the needlebar(s) is/are slowed or halted when the needles are at top dead center to avoid the needles tagging the back-stitches.

4. The method for running a tufting machine claimed in claim 1 or 2 wherein the knives are moved forward to cut the loops at a point where the loops have the same length.

5. The method for running a tufting machine claimed in claim 3 wherein the knives are moved forward to cut the loops at a point where the loops have the same length.

* * * * *